US007445453B2

(12) United States Patent
Minich et al.

(10) Patent No.: US 7,445,453 B2
(45) Date of Patent: Nov. 4, 2008

(54) PICKUP CAP FOR AN ELECTRICAL CONNECTOR

(75) Inventors: Steven E. Minich, York, PA (US); Gregory A. Hull, York, PA (US)

(73) Assignee: FCI Americas Technology, Inc., Carson City, NV (US)

( * ) Notice: Subject to any disclaimer, the term of this patent is extended or adjusted under 35 U.S.C. 154(b) by 249 days.

(21) Appl. No.: 11/098,859

(22) Filed: Apr. 5, 2005

(65) Prior Publication Data

US 2006/0218784 A1 Oct. 5, 2006

(51) Int. Cl.
*H01R 13/60* (2006.01)

(52) U.S. Cl. ..... 439/41; 439/940

(58) Field of Classification Search ..... 439/41, 439/135, 940, 47

See application file for complete search history.

(56) References Cited

U.S. PATENT DOCUMENTS

| | | | | |
|---|---|---|---|---|
| 5,026,295 | A | 6/1991 | Fong et al. | 439/135 |
| 5,147,209 | A | 9/1992 | Liftwin et al. | 439/70 |
| 5,242,311 | A | 9/1993 | Seong | 439/135 |
| 5,571,022 | A | 11/1996 | Schaarschmidt | 439/135 |
| 5,651,684 | A | 7/1997 | Northey et al. | 439/41 |
| 5,688,133 | A * | 11/1997 | Ikesugi et al. | 439/135 |
| 6,019,617 | A * | 2/2000 | Liu et al. | 439/135 |
| 6,116,949 | A * | 9/2000 | Costello et al. | 439/509 |
| 6,146,155 | A | 11/2000 | Boling et al. | 439/79 |
| 6,413,111 | B1 | 7/2002 | Pickles et al. | 439/342 |
| 6,439,901 | B1 | 8/2002 | Ji et al. | 439/135 |
| 6,478,588 | B1 | 11/2002 | Howell et al. | 439/135 |
| 6,533,592 | B1 * | 3/2003 | Chen et al. | 439/135 |
| 6,554,624 | B1 | 4/2003 | Yu | 439/135 |
| 6,554,625 | B1 | 4/2003 | Liao et al. | 439/135 |
| 6,561,825 | B1 | 5/2003 | McHugh et al. | 439/135 |
| 6,572,383 | B1 | 6/2003 | Yu | 439/41 |
| 6,599,140 | B1 | 7/2003 | Chen et al. | 439/135 |
| 6,753,474 | B2 | 6/2004 | Trout | 174/66 |
| 6,769,924 | B1 | 8/2004 | Korsunsky et al. | 439/83 |
| 6,783,369 | B2 | 8/2004 | Zhang | 439/41 |
| 6,830,457 | B1 | 12/2004 | Korsunsky et al. | 439/41 |
| 7,033,183 | B2 * | 4/2006 | Ma et al. | 439/41 |
| 2004/0097104 | A1 | 5/2004 | Zhang | 439/41 |
| 2004/0175974 | A1 | 9/2004 | Ma et al. | 439/135 |
| 2004/0248442 | A1 * | 12/2004 | Huang | 439/135 |

OTHER PUBLICATIONS

U.S. Appl. No. 11/540,881, filed Sep. 2006, Minich.

* cited by examiner

*Primary Examiner*—Tho D. Ta
*Assistant Examiner*—Travis Chambers
(74) *Attorney, Agent, or Firm*—Woodcock Washburn LLP

(57) ABSTRACT

A preferred embodiment of a pickup cap for an electrical connector includes a first portion having a substantially planar major surface. The pickup cap also includes a first and a second beam extending from the first portion for interferedly engaging projecting features on the electrical connector so that the pickup cap can be held on the electrical connector by frictional forces between the projecting features and the first and second beams.

26 Claims, 5 Drawing Sheets

PICKUP CAP FOR AN ELECTRICAL CONNECTOR

FIELD OF THE INVENTION

The present invention relates to a pickup cap that can be mounted on an electrical connector and held by a device such as a vacuum nozzle, so that the electrical connector can be lifted and moved during manufacturing and other operations.

BACKGROUND OF THE INVENTION

Electrical connectors are commonly lifted and positioned on a mounting surface using automated equipment referred to as "pick and place" equipment. The pick and place equipment typically includes a vacuum nozzle mounted on an arm or other movable structure.

A pickup cap is usually placed on the connector to provide a suitable surface for the vacuum nozzle to grasp. Pickup caps are typically equipped with latches or other locking features for securing the pickup cap to the electrical connector. The inclusion of locking features in a pickup cap, in general, adds material and weight to the pickup cap. The additional weight associated with the locking features can be particularly disadvantageous when the pickup cap is used with a surface-mount connector such as a ball-grid array (BGA) connector. In particular, the additional weight can potentially interfere with the proper formation of solder connections between the connector and the mounting surface.

Locking features can inhibit quick and easy removal of the pickup cap from the connector after the connector is mounted. Moreover, the force needed to overcome the resistance of locking features can in some cases damage the newly formed solder connections. Also, locking features may be relatively small and delicate, and therefore may break or otherwise fail under repeated use.

SUMMARY OF THE INVENTION

The present invention is directed to a pickup cap that can be secured to an electrical connector without the use of latches or other locking features, thereby alleviating disadvantages associated with locking features.

A preferred embodiment of a pickup cap for an electrical connector that defines at least one contact orifice comprises a center portion having a vacuum engagement surface, and connector engagement arms attached to the vacuum engagement surface. The pickup cap is removably connected to the electrical connector, and the connector engagement arms do not extend into the at least one contact orifice.

Another preferred embodiment of a pickup cap for an electrical connector comprises a first portion having a substantially planar major surface. The pickup cap also comprises a first and a second beam extending from the first portion for interferedly engaging projecting features on the electrical connector so that the pickup cap can be held on the electrical connector by frictional forces between the projecting features and the first and second beams.

A preferred method for mounting a pickup cap on an electrical connector comprises bringing a first and a second beam of the pickup cap into contact with a respective first and second projecting feature on the electrical connector. The preferred method also comprises urging the pickup cap toward the electrical connector so that the first and second beams resiliently deflect in response to contact with the respective first and second projecting features thereby generating contact forces between the first and second beams and the respective first and second projecting features that cause the pickup cap to be retained on the electrical connector.

BRIEF DESCRIPTION OF THE DRAWINGS

The foregoing summary, as well as the following detailed description of a preferred embodiment, are better understood when read in conjunction with the appended diagrammatic drawings. For the purpose of illustrating the invention, the drawings show an embodiment that is presently preferred. The invention is not limited, however, to the specific instrumentalities disclosed in the drawings. In the drawings.

DETAILED DESCRIPTION OF ILLUSTRATIVE EMBODIMENTS

FIGS. 1-5 and 7A-9 depict a preferred embodiment of a pickup cap 10. The pickup cap 10 can be used in conjunction with an electrical connector 12. The pickup cap 10 can be mounted on the electrical connector 12 in the manner described below.

The pickup cap 10 can be used in conjunction with pick and place equipment to lift and move the connector 12. In particular, the pickup cap 10 can be grasped by a suitable device such as a vacuum nozzle (not shown). The vacuum nozzle can be coupled to a movable arm or other feature that can lift the vacuum nozzle, pickup cap 10, and connector 12, and place the connector 12 on a mounting surface of a substrate. The connector 12 can subsequently be mounted on the substrate using a suitable process such as solder reflow.

The connector 12 is a surface-mount, BGA receptacle connector. The pickup cap 10 is described in conjunction with the connector 12 for exemplary purposes only. The pickup cap 10 can be used with other types of connectors, including connectors other than surface-mount, BGA receptacle connectors.

Figure 1:
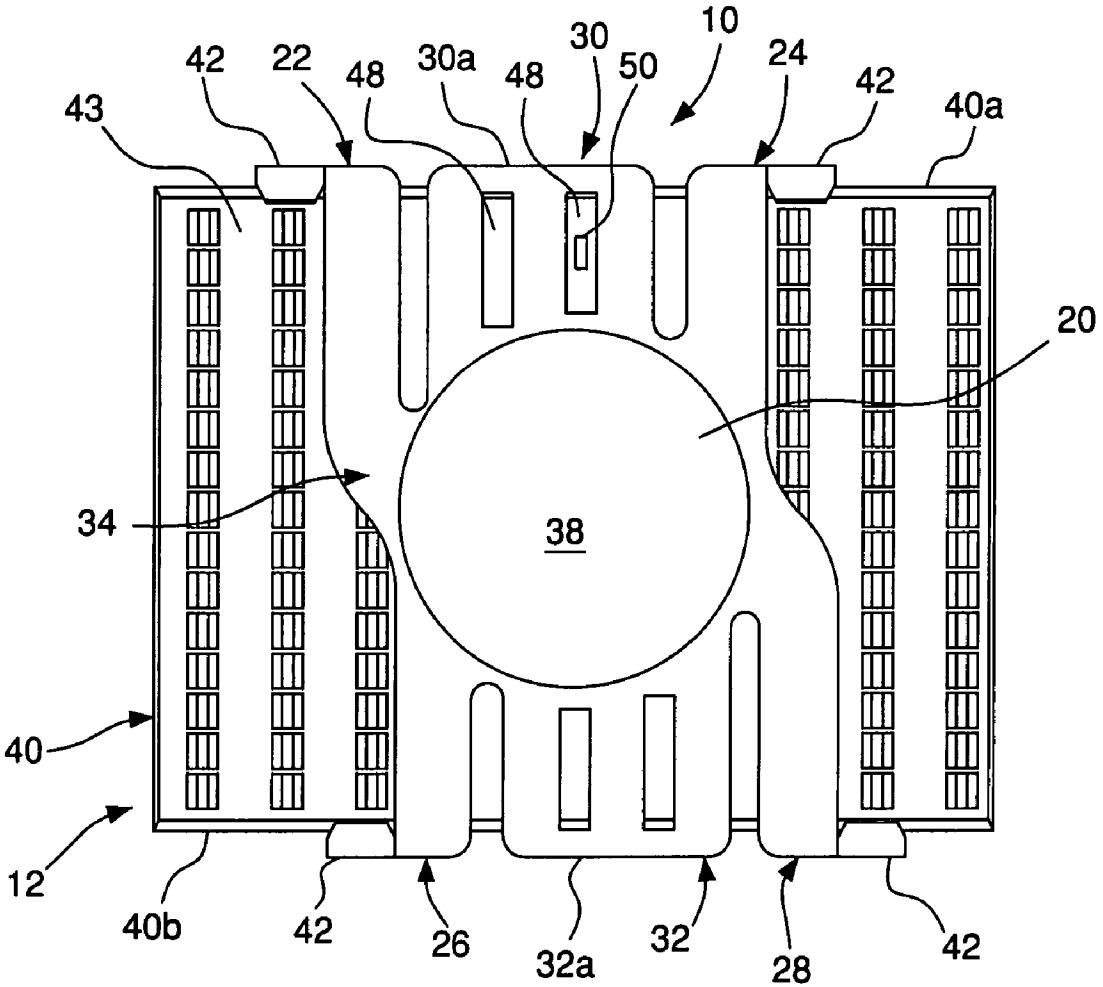
FIG. 1 is a top view of a preferred embodiment of a pickup cap, installed on an electrical connector.

The pickup cap 10 comprises a center portion 20 as shown, for example, in FIG. 1. The pickup cap 10 also comprises a first beam 22, a second beam 24, a third beam 26, and a fourth beam 28 that each adjoin the center portion 20. The pickup cap 10 further comprises a first arm 30 and a second arm 32 that each adjoin the center portion 20.

Figures 2, 3, 4, 5:
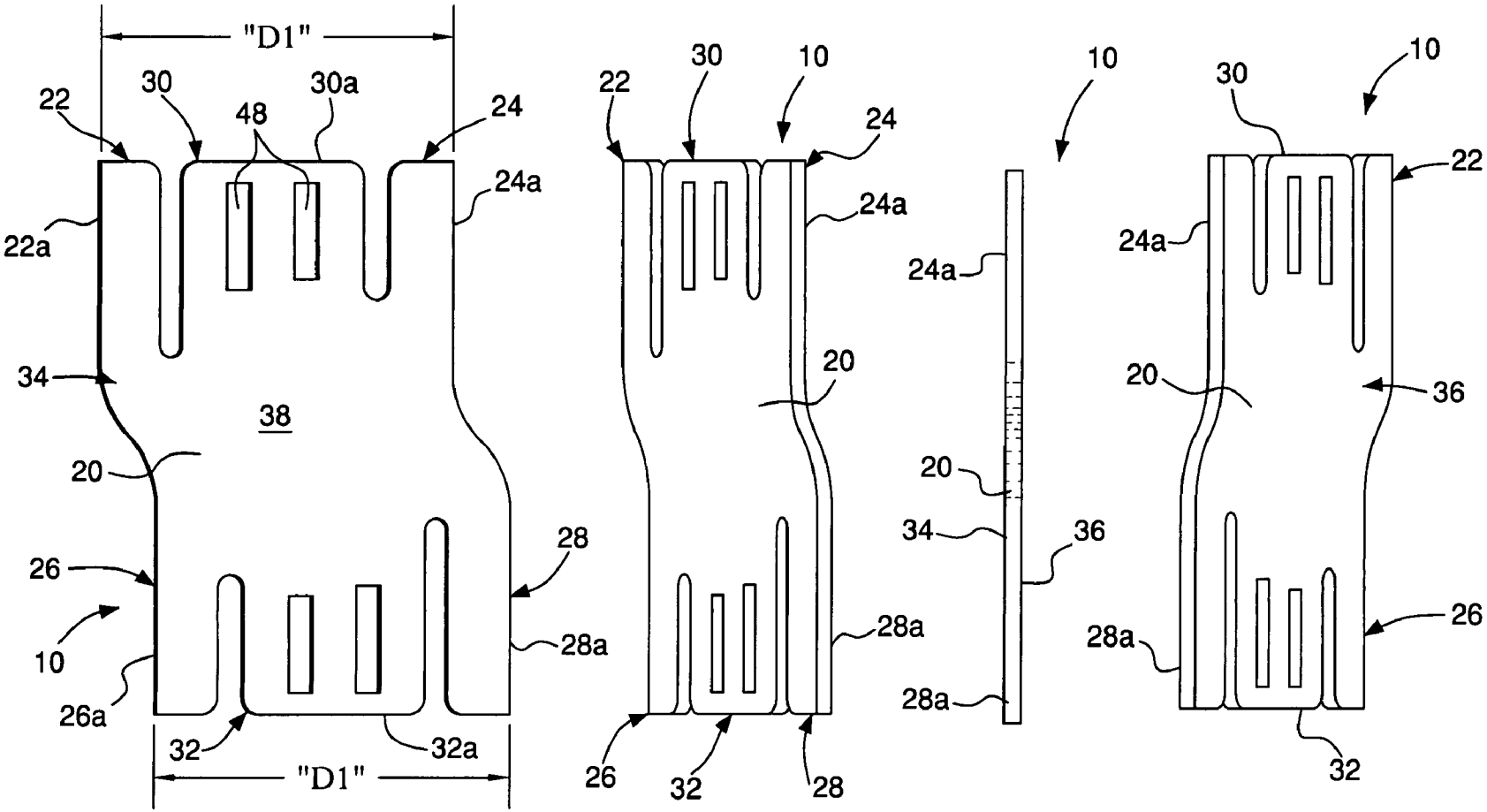
FIG. 2 is a top view of the pickup cap shown in FIG. 1.
FIG. 3 is a perspective view of the pickup cap shown in FIGS. 1 and 2.
FIG. 4 is a side view of the pickup cap shown in FIGS. 1-3.
FIG. 5 is another perspective view of the pickup cap shown in FIGS. 1-4.

The pickup cap 10 has a first face, or side 34, and a second face, or side 36. The second side is depicted in FIG. 5. Preferably, the pickup cap 10 has a substantially uniform thickness and is substantially flat, as depicted in FIG. 4. In other words, the first and second sides 34, 36 preferably are substantially planar, and substantially parallel. Preferably, the pickup cap 10 is configured so that the pickup cap 10 can be mounted on the connector 12 with either the first side 34 or the second side 36 facing outward.

The center portion 20 has a major surface 38 as shown, for example, in FIG. 1. The major surface 38 is substantially planar and continuous, so that the major surface 38 can be held by a vacuum nozzle. In particular, the noted features of the major surface 38 permit the vacuum nozzle to exert a suction force on the major surface 38 when the vacuum nozzle is brought into contact with the major surface 38. The suction force holds the pickup cap 10, and the attached connector 12, on the vacuum nozzle.

Figure 6:
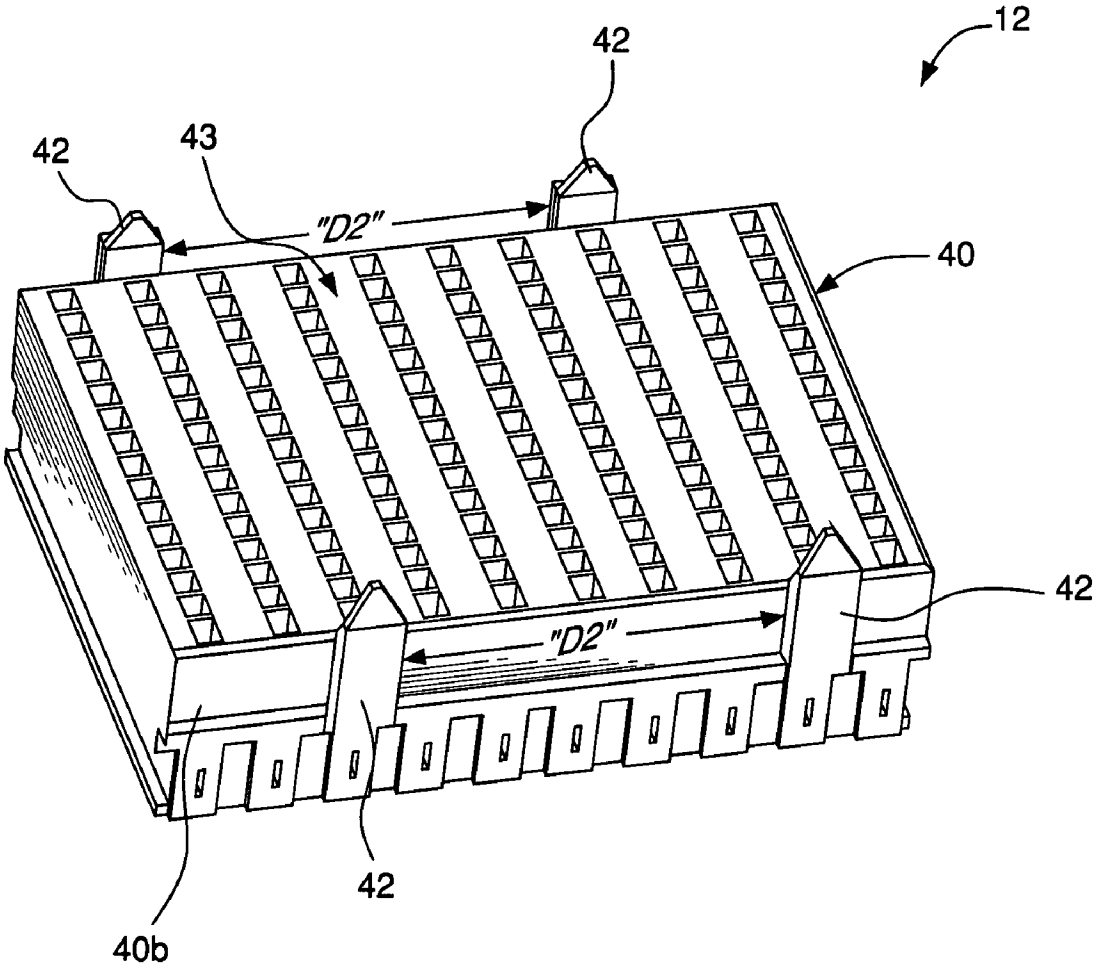
FIG. 6 is a perspective view of the electrical connector shown in FIG. 1.
Figure 7C:
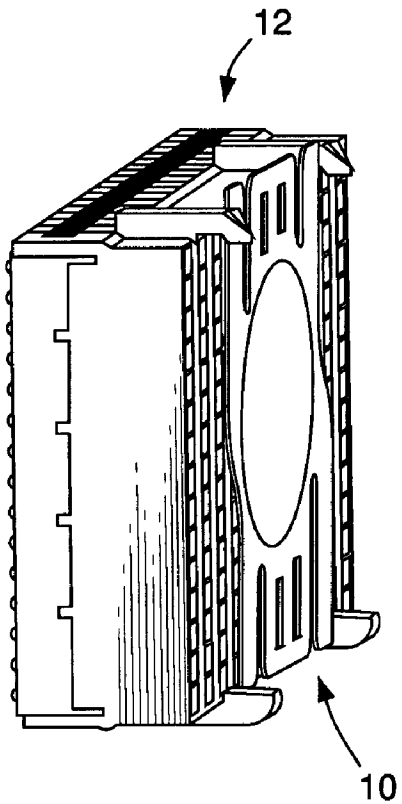
FIGS. 7A-7C are perspective views depicting, in sequence, the pickup cap shown in FIGS. 1-5 being placed on the electrical connector shown in FIGS. 1 and 6.

The first, second, third and fourth beams 22, 24, 26, 28 are used to mount the pickup cap 10 on the electrical connector 12. The electrical connector 12 comprises a housing 40 as shown, for example, in FIG. 6. The housing 40 includes projecting features in the form of guide posts 42. Two guide posts 42 are positioned on a first side 40*a* of the housing 40. Another two of the guide posts 42 are positioned on a second side 40*b* of the housing 40. The projections 42 extend beyond a mating face 43 of the connector 12, as shown in FIGS. 6-7C.

The guide posts 42 are received by complementary features formed in a plug connector (not shown) as the plug connector is mated with the connector 12. The guide posts 42 guide the plug connector toward the mating face 43 of the connector 12, to facilitate proper mating of the plug connector and the connector 12.

The pickup cap 10 is configured so that the first, second, third, and fourth beams 22, 24, 26, 28 each contact a respective one of the guide posts 42 when the pickup cap 10 is placed on the connector 12. This contact, as explained below, causes the first, second, third, and fourth beams 22, 24, 26, 28 to resiliently deflect. The deflection results in a frictional force between each of the first, second, third, and fourth beams 22, 24, 26, 28 and the associated guide post 42. The frictional forces help to retain the pickup cap 10 on the connector 12.

The first and second beams 22, 24 have respective outer edges 22*a*, 24*a*, as shown in FIGS. 1-5. The outer edges 22*a*, 24*a* are spaced by a distance, designated "D1" in FIG. 2, when the pickup cap 10 is not mounted on the connector 12. The outer edges 22*a*, 24*a* of the respective first and second beams 22, 24 contact the guide posts 42 located on the first side 40*a* of the housing 40, when the pickup cap 10 is positioned on the connector 12. The guide posts 42 on the first side 40*a* are spaced by a distance designated "D2" in FIG. 6.

The third and fourth beams 26, 28 have respective outer edges 26*a*, 28*a*, as depicted in FIGS. 1-5. The outer edges 26*a*, 28*b* are spaced by a distance approximately equal to the distance "D1" when the pickup cap 10 is not mounted on the connector 12. The outer edges 26*a*, 28*a* of the respective third and fourth beams 26, 28 contact the guide posts 42 located on the second side 40*b* of the housing 40, when the pickup cap 10 is positioned on the connector 12. The guide posts 42 on the second side 40*b* are spaced by a distance approximately equal to the distance "D2."

Figure 7B:
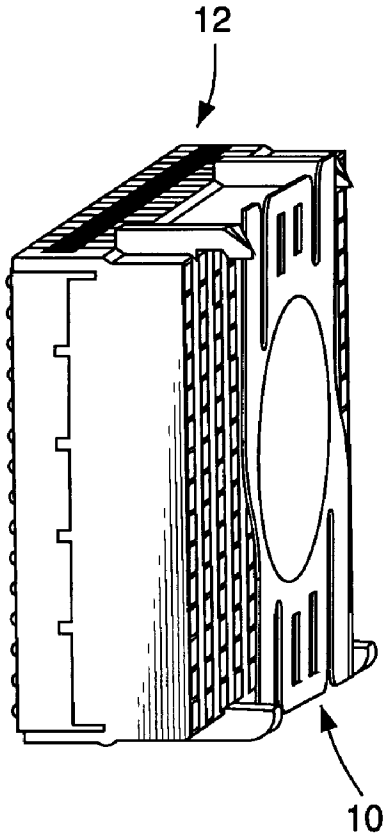
Figure 7A:
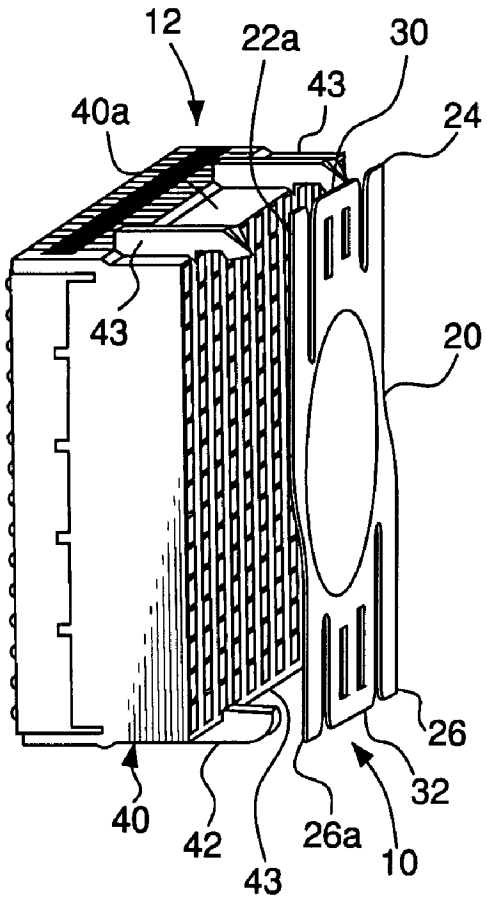

FIGS. 7A-7C depict the pickup cap 10 being placed on the connector 12. The pickup cap 10 can be placed on the connector 12 manually, or using automated equipment (not shown). Although the connector 12 and the pickup cap 10 are each shown in a vertical orientation in FIGS. 7A-7B, the connector 12 and the pickup cap 10 can be oriented otherwise during placement of the pickup cap 10.

The first and second beams 22, 24 deflect inward as the pickup cap 10 is urged onto the connector 12, since the spacing between the guide posts 42 on the first side 40*a* is less than the spacing between the outer edges 22*a*, 24*a*, i.e., since the distance D2 is less than the distance D1. In other words, interference between the first and second beams 22, 24 and the associated guide posts 42 causes the first and second beams 22, 24 to deflect toward each other, in substantially opposite directions.

The third and fourth beams 26, 28 likewise deflect inward as the pickup cap 10 is positioned on the connector 12, since the spacing between the guide posts 42 on the second side 40*b* is less than the spacing between the outer edges 26*a*, 28*b*. Interference between the third and fourth beams 26, 28 and the associated guide posts 42 thus causes the third and fourth beams 26, 28 to deflect toward each other, in substantially opposite directions.

The first, second, third, and fourth beams 22, 24, 26, 28 are configured to deflect resiliently in response to the noted contact with the associated guide posts 42. The resilience of the first, second, third, and fourth beams 22, 24, 26, 28 results in a contact force between each of the first, second, third, and fourth beams 22, 24, 26, 28, and its associated guide post 42. These contact forces, in turn, cause friction between the first, second, third, and fourth beams 22, 24, 26, 28, and the associated guide posts 42. More particularly, frictional forces are generated between the outer edges 22*a*, 24*a*, 26*a*, 28*a*, and the contacting surfaces of the associated guide posts 42. The frictional forces discourage movement of the first, second, third, and fourth beams 22, 24, 26, 28 away from the mating face 43 of the housing 40, and thereby retain the pickup cap 10 on the connector 12.

The above-noted contact forces are related to the resilience of the first, second, third, and fourth beams 22, 24, 26, 28. The resilience of the first, second, third, and fourth beams 22, 24, 26, 28, in turn, is related to the mechanical properties of the material from which the first, second, third, and fourth beams 22, 24, 26, 28 are formed, and to the geometry, e.g., the length and thickness, of the first, second, third, and fourth beams 22, 24, 26, 28.

The optimal value or values for the contact forces between the first, second, third, and fourth beams 22, 24, 26, 28 and the guide posts 42 is application dependent. For example, the contact forces should be large enough so that the resulting frictional forces, in the aggregate, are greater than the combined weight of the connector 12 and the pickup cap 10. The contact forces should not be large enough, however, to result in damage or permanent deformation of the guide posts 42 or the pickup cap 10. Moreover, the contact forces should be low enough to facilitate removal of the pickup cap 10 from the connector 12 with a relatively low amount of applied force.

The pickup cap 10 should be formed from a material capable of deforming resiliently when subject to contact forces within the desired range. For example, the pickup cap 10 can be formed from LCP or HTN, although other types of materials can be used in alternative embodiments.

Figure 9:
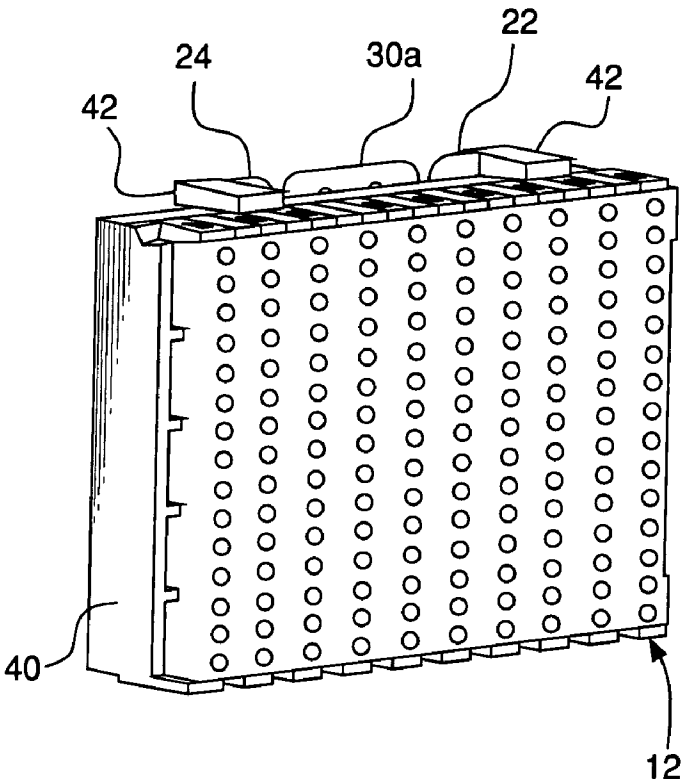
FIG. 9 is a bottom perspective view of the pickup cap and the electrical connector shown in FIGS. 1-8.
Figure 8:
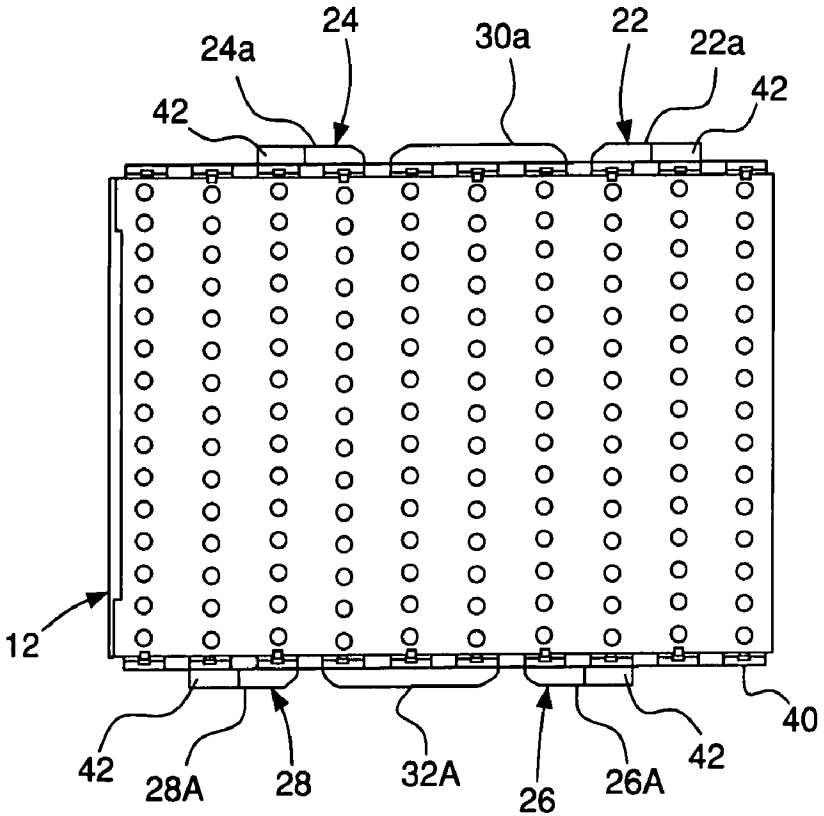
FIG. 8 is a bottom view of the pickup cap and the electrical connector shown in FIGS. 1-7C.

The first and second arms 30, 32 can facilitate removal of the pickup cap 10 from the connector 12 after the connector 12 has been mounted. In particular, the first and second arms 30, 32 each preferably have a length that causes a respective end 30*a*, 32*a* of the first and second arms 30, 32 to overhang the edges of the respective first and second sides 40*a*, 40*b* of the housing 40. This feature is depicted in FIGS. 8 and 9. The overhanging ends 30*a*, 32*a* can be lifted by hand or by a suitable automated device after the connector 12 has been mounted on the substrate, to remove the pickup cap 10 from the connector 12.

The pickup cap 10 can be mounted on and retained by the connector 12 without the use of latches or other locking features. The pickup cap 10 therefore can be formed using less material than a conventional pickup cap of comparable capability, making the pickup cap 10 lighter than a conventional cap. The relatively low weight of the pickup cap 10 can be particularly beneficial when the pickup cap 10 is used in conjunction with a BGA connector such as the connector 12. In particular, the relatively low weight of the pickup cap 10, it is believed, can reduce the potential for the weight of the pickup cap 12 to interfere with the proper formation of the solder connections between the connector 12, and the substrate on which the connector 12 is mounted.

The retention force generated by the pickup cap 10 can be optimized for a particular application by varying one or more aspects of the geometry of the first, second, third, and fourth beams 22, 24, 26, 28. Hence, the same basic configuration for the pickup cap 10 can be used in different applications.

The pickup cap 10 can be removed from the connector 12 with one relatively simple motion, i.e., by lifting the ends 30*a*, 32*a* of the respective first and second arms 30, 32. Moreover, as discussed above, the contact forces between the first, second, third, and fourth beams 22, 24, 26, 28 and the associated guide posts 42 can be tailored to minimize the force needed to remove the pickup cap 10 from the connector 12, thereby reducing the potential for damage to the newly-formed solder connections between the connector 12 and the mounting surface.

The pickup cap 10 can be stacked with other pickup caps 10 relatively easily due to its substantially flat profile. Moreover, the various parts of the pickup cap 10 are relatively large and robust, minimizing the potential for the pickup cap 10 to break or otherwise fail during use.

The foregoing description is provided for the purpose of explanation and is not to be construed as limiting the invention. While the invention has been described with reference to preferred embodiments or preferred methods, it is understood that the words which have been used herein are words of description and illustration, rather than words of limitation. Furthermore, although the invention has been described herein with reference to particular structure, methods, and embodiments, the invention is not intended to be limited to the particulars disclosed herein, as the invention extends to all structures, methods and uses that are within the scope of the appended claims. Those skilled in the relevant art, having the benefit of the teachings of this specification, may effect numerous modifications to the invention as described herein, and changes may be made without departing from the scope and spirit of the invention as defined by the appended claims.

For example, alternative embodiments of the pickup cap 10 can include more, or less than four beams. Moreover, the specific geometric features of the pickup cap 10 disclosed herein are tailored to the particular locations of the guide posts 42 on the connector 12. The geometry of the pickup cap 10, e.g., the shape and relative locations of the first, second, third, and fourth beams 22, 24, 26, 28, can be varied to accommodate connectors having guide posts in locations other than those of the guide posts 42.

The pickup cap 10, and alternative embodiments thereof, can be configured for use with connectors having projecting features other than the guide posts 42. Furthermore, alternative embodiments of the pickup cap 10 can be configured so that the inner edges, rather than the outer edges of the first, second, third, and fourth beams 22, 24, 26, 28 contact the guide posts 42 or other projecting features. Alternatively, the beams can contact the inner and outer edges of the guide posts 42. Moreover, the pickup cap 10 may define slots 48 that mate with orifices 50 extending through the electrical connector, so that heat can pass through the slots 48 and into the orifices 50 defined by the electrical connector to aid fusible element heat transfer. Only one of the orifices 50 is depicted in FIG. 1, and the orifices 50 are not depicted in any of the other figures, for clarity.

What is claimed:

1. A pickup cap for an electrical connector, said pickup cap comprising:

a center portion having a vacuum engagement surface;

connector engagement arms each having a major surface that lies in a plane that is substantially parallel to or coincident with the vacuum engagement surface, wherein the pickup cap is configured to removably connect to the electrical connector;

the connector engagement arms comprising a first beam and a second beam adjoining the vacuum engagement surface and lying in a plane that is substantially parallel to or coincident with the vacuum engagement surface; wherein the first beam and the second beam are configured to contact projecting features on the electrical connector so as to provide a contact force between the first and second beams and the projecting features on the electrical connector, the contact force resisting separation of the cap and the electrical connector.

2. The pickup cap of claim 1, further comprising a third beam and a fourth beam adjoining the vacuum engagement surface for contacting additional projecting features on the electrical connector so that the third and fourth beams resiliently deflect in substantially opposite directions to create contact forces between the additional projecting features and the third and fourth beams that further cause the pickup cap to be retained on the electrical connector when the pickup cap is lifted by a vacuum nozzle.

3. The pickup cap of claim 1, further comprising a first and second body adjoining the vacuum engagement surface and being sized so that respective ends of the first and second bodies extend beyond edges of the electrical connector when the pickup cap is mounted on the electrical connector wherein the pickup cap can be removed from the electrical connector by lifting the respective ends of the first and second bodies.

4. The pickup cap of claim 1, wherein the contact forces generate frictional forces between the projecting features and the first and second beams that cause the pickup cap to be retained on the electrical connector when the pickup cap is lifted by a vacuum nozzle.

5. The pickup cap of claim 1, wherein the first and second beams are configured to contact guide posts on the electrical connector as the pickup cap is placed on the electrical connector.

6. The pickup cap of claim 1, wherein the pickup cap further defines slots that mate with heat transfer orifices defined by the electrical connector, so that heat can pass through the slots and into the heat transfer orifices defined by the electrical connector to aid fusible element heat transfer.

7. The pickup cap of claim 1, wherein the pickup cap has a first and a second side, and the pickup cap can be mounted on the electrical connector so that either of the first and second sides faces the electrical connector.

8. The pickup cap of claim 1, wherein the first and second beams further comprise outer edges for contacting the projecting features on the electrical connector when the pickup cap is mounted on the electrical connector, the outer edges are spaced by a first distance when the pickup cap is not mounted on the electrical connector, and the projecting features are spaced by a second distance less than the first distance so that the first and second beams deflect in response to contact with the projecting features when the pickup cap is mounted on the electrical connector.

9. The pickup cap of claim 1, wherein the center portion and the first and second beams have a substantially uniform thickness.

10. The pickup cap of claim 1, wherein the first and second beams are for resiliently deflecting toward each other in response to the contact with the projecting features.

11. The pickup cap of claim 1, wherein the first beam and the second beam are deflected by the projecting features on the electrical connector when the pickup cap is connected to the electrical connector so that the pickup cap can be held on the electrical connector by frictional forces that are greater than a combined weight of the pickup cap and the electrical connector.

12. The pickup cap of claim 1, A pickup cap for an electrical connector, wherein the pickup cap defines at least one contact orifice, and the connector engagement arms do not extend into the at least one contact orifice.

13. The pickup cap of claim 1, wherein the pickup cap is substantially flat.

14. A pickup cap for an electrical connector, comprising:

a first portion having a substantially planar major surface; and a first and a second beam extending in a direction of extension from the first portion, wherein the direction of extension is in a direction substantially parallel to the substantially planar major surface, and the first and second beams are configured to interferedly engage projecting features on the electrical connector so that the pickup cap can be held on the electrical connector by frictional forces between the projecting features and the first and second beams, wherein the first and second beams deflect in a direction substantially perpendicular to the direction of extension such that the frictional forces resist separation of the pickup cap and the electrical connector.

15. The pickup cap of claim 14, further comprising a third and a fourth beam extending from the first portion for interferedly engaging additional projecting features on the electrical connector so that the pickup cap can be further held on the electrical connector by frictional forces between the additional projecting features and the third and fourth beams.

16. The pickup cap of claim 14, wherein the first and second beams are for deflecting in substantially opposite directions in response to the engagement of the projecting features and the first and second beams.

17. The pickup cap of claim 14, wherein the first portion and the first and second beams have a substantially uniform thickness.

18. The pickup cap of claim 14, further comprising a first and a second body extending from the first portion and being sized so that respective ends of the first and second bodies are for overhanging edges of the electrical connector when the pickup cap is mounted on the electrical connector, and for removing the pickup cap from the electrical connector by lifting the ends of the first and second bodies.

19. The pickup cap of claim 14, wherein the pickup cap has a first and a second side, and the pickup cap are for mounting on the electrical connector so that either of the first and second sides faces the connector.

20. The pickup cap of claim 14, wherein the frictional forces are greater than a combined weight of the cap and the electrical connector.

21. The pickup cap of claim 14, wherein the pickup cap is substantially flat.

22. A method for mounting a pickup cap on an electrical connector, wherein the pickup cap includes a vacuum engagement surface, and a first beam and a second beam each adjoining the vacuum engagement surface and lying in a plane that is substantially parallel to or coincident with the vacuum engagement surface, the method comprising:

bringing a first and a second beam of the pickup cap into contact with respective first and second projecting features on the electrical connector; and urging the pickup cap toward the electrical connector so that the first and second beams resiliently deflect in response to the contact with the respective first and second projecting features thereby generating contact forces between the first and second beams and the respective first and second projecting features that cause the pickup cap to be retained on the electrical connector.

23. The method of claim 22, further comprising bringing a third and a fourth beam of the pickup cap into contact with a respective third and fourth projecting feature on the electrical connector, and urging the pickup cap toward the electrical connector so that the third and fourth beams resiliently deflect in response to contact with the respective third and fourth projecting features thereby generating contact forces between the third and fourth beams and the respective third and fourth projecting features that cause the pickup cap to be retained on the electrical connector.

24. The method of claim 22, wherein bringing a first and a second beam of the pickup cap into contact with a respective first and second projecting feature on the electrical connector comprises bringing the first and the second beams into contact with a respective first and second guide post of a housing of the electrical connector.

25. The method of claim 22, wherein the first and second beams extend in a direction of extension resiliently deflect in a direction substantially perpendicular to the direction of extension and along a plane substantially perpendicular to or coincident with a vacuum engagement surface of the pickup cap to generate the contact forces.

26. The method of claim 22, wherein the pickup cap is substantially flat.

* * * * *